US010546737B2

(12) United States Patent
Makarov et al.

(10) Patent No.: US 10,546,737 B2
(45) Date of Patent: Jan. 28, 2020

(54) METHOD AND APPARATUS FOR THE ANALYSIS OF MOLECULES USING MASS SPECTROMETRY AND OPTICAL SPECTROSCOPY

(71) Applicants: Thermo Fisher Scientific (Bremen) GmbH, Bremen (DE); ECOLE POLYTECHNIQUE FEDERALE DE LAUSANNE (EPFL), Lausanne (CH)

(72) Inventors: Alexander Makarov, Bremen (DE); Oleg Boyarkine, Bremblens (CH); Vladimir Kopysov, Lausanne (CH)

(73) Assignees: Thermo Fisher Scientific (Bremen) GmbH, Bremen (DE); Ecole Polytechnique Federale de Lausanne (EPFL), Lausanne (CH)

( * ) Notice: Subject to any disclaimer, the term of this patent is extended or adjusted under 35 U.S.C. 154(b) by 0 days.

(21) Appl. No.: 16/385,372

(22) Filed: Apr. 16, 2019

(65) Prior Publication Data

US 2019/0244798 A1 Aug. 8, 2019

Related U.S. Application Data

(63) Continuation of application No. 15/519,126, filed as application No. PCT/EP2015/073650 on Oct. 13, 2015, now Pat. No. 10,283,336.

(30) Foreign Application Priority Data

Oct. 17, 2014 (GB) ..... 1418436

(51) Int. Cl.
*H01J 49/00* (2006.01)

(52) U.S. Cl.
CPC ..... *H01J 49/0059* (2013.01); *H01J 49/0031* (2013.01)

(58) Field of Classification Search
CPC ..... H01J 49/00; H01J 49/02; H01J 49/0027; H01J 49/0045; H01J 49/005; H01J 49/0059

(Continued)

(56) References Cited

U.S. PATENT DOCUMENTS 6,642,516 B1 11/2003 Hansen et al.
2003/0155498 A1* 8/2003 Kato ..... H01J 49/0095 250/281

(Continued)

FOREIGN PATENT DOCUMENTS

CN 103650099 A 3/2014
JP 2005-300480 A 10/2005

(Continued)

OTHER PUBLICATIONS

Stearns et al., Conformation-Specific Spectroscopy and Photodissociation of Cold, Protonated Tyrosine and Phenylalanine, May 2007, Journal of the American Chemical Society, vol. 129, No. 38, pp. 11814-11820. (Year: 2007).*

(Continued)

*Primary Examiner* — Jason L McCormack
(74) *Attorney, Agent, or Firm* — David A. Schell

(57) ABSTRACT

A method of analyzing molecules, comprising: generating ions from a sample of molecules; cooling the generated ions below ambient temperature; fragmenting at least some of the cooled ions by irradiating the ions with light at a plurality of different wavelengths (λ) within one or more predetermined spectral intervals; recording a fragment mass spectrum of the fragmented ions comprising a detected signal (I) versus m/z over a predetermined range of m/z values for each of the plurality of different wavelengths (λ), thereby recording a two-dimensional dependency of the detected signal (I) on m/z and irradiation wavelength (λ); and determining from (Continued)

the recorded two-dimensional dependency an identity of at least one of the generated ions and/or relative abundances of different generated ions and thereby determining an identity of at least of one of the molecules and/or relative abundances of different molecules in the sample.

18 Claims, 9 Drawing Sheets

(58) Field of Classification Search
USPC ..... 250/281, 282, 283, 284
See application file for complete search history.

(56) References Cited

U.S. PATENT DOCUMENTS

| | | | | |
|---|---|---|---|---|
| 2003/0183760 | A1* | 10/2003 | Tsybin | H01J 49/0054 250/292 |
| 2005/0103991 | A1* | 5/2005 | Walk | H01J 49/421 250/282 |
| 2006/0085142 | A1 | 4/2006 | Mistrik | |
| 2010/0108879 | A1 | 5/2010 | Bateman et al. | |
| 2011/0006200 | A1* | 1/2011 | Loboda | H01J 49/0031 250/283 |
| 2011/0174965 | A1 | 7/2011 | Collings | |
| 2014/0145073 | A1 | 5/2014 | Johnson et al. | |
| 2014/0224975 | A1 | 8/2014 | Kuehn et al. | |
| 2015/0090874 | A1* | 4/2015 | Larson | H01J 49/0045 250/282 |

FOREIGN PATENT DOCUMENTS

| | | | |
|---|---|---|---|
| JP | 2007046966 | A | 2/2007 |
| JP | 2014520271 | A | 8/2014 |
| JP | 2014521059 | A | 8/2014 |
| WO | 2012/175517 | A2 | 12/2012 |

OTHER PUBLICATIONS

Stearns et al., Conformation-Specific Spectroscopy and Photodissociation of Cold, Protonated Tyrosine and Phenylalanine, May 2007, Journal of the American Chemical Society, vol. 129, No. 38, pp. 11820. (Year: 2007).*

Balaj et al., "Vibrational signatures of sodiated oligopeptides (GG-Na+, GGG-Na+, AA-Na+ and AAA-Na+) in the gas phase", International Journal of Mass Spectrometry 269 (2008), pp. 196-209.

Goebbert et al., "10K Ring Electrode Trap—Tandem MassSpectrometer for Infrared Spectroscopy of Mass Selected Ions", American Institute of Physics, vol. 1104, 22, 2009, pp. 22-29.

Gorshkov et al., "A Dynamic Ion Cooling Technique for FTICRMass Spectrometry", J Am Soc Mass Spectrom 2001, 12, pp. 1169-1173.

Kopysov et al., "Identification of Tyrosine-Phosphorylated Peptides Using Cold Ion Spectroscopy". J. Am. Chem. Soc. 2014, 136, pp. 9288-9291.

Maitre et al., "Ultrasensitive spectroscopy of ionic reactive intermediates in the gas phase performed with the first coupling of an IR FEL with an FTICR-MS", Nucl. Instrum. Meth. B [online], 2003, vol. 507, pp. 541-546; http://dx.doi.org/10.1016/S0168-9002(03)00914-8.

* cited by examiner

Structure II

Structures I and III

TSAAATSpY (a)

(b)

TSAAATpSY

TSAAApTSY (c)

(d)

TpSAAATSY (e)

pTSAAATSY

MIXTURE= $TSA_3TSpY + TSA_3pTSY + TSA_3TpSY$ (f)

METHOD AND APPARATUS FOR THE ANALYSIS OF MOLECULES USING MASS SPECTROMETRY AND OPTICAL SPECTROSCOPY

CROSS-REFERENCE TO RELATED APPLICATIONS

This application is a continuation under 35 U.S.C. § 120 and claims the priority benefit of co-pending U.S. patent application Ser. No. 15/519,126, filed Apr. 13, 2017, which is a National Stage application under 35 U.S.C. § 371 of PCT Application No. PCT/EP2015/073650, filed Oct. 13, 2015. The disclosures of each of the foregoing applications are incorporated herein by reference.

FIELD

The present disclosure relates to the analysis of molecules and their mixtures, in particular the analysis by mass spectrometry and optical spectroscopy. Aspects of the disclosure relate to a method of, and an apparatus for, analyzing a sample of molecules.

BACKGROUND

There exist many different techniques for the analysis of molecules. One such technique is optical spectroscopy, in particular optical absorption spectroscopy. Such spectroscopy may be carried out in the infrared (IR), visible (Vis), or ultraviolet (UV) regions. Vibrationally resolved UV-Vis/IR spectroscopy of small polyatomic molecules in the gas phase has been used for decades to generate specific molecular fingerprints. This allows identification of the molecules and, in conjunction with theoretical calculations, their structural determination. However, it becomes very challenging to use the technique for large molecules (e.g. proteins and peptides) due to the complexity of their spectra and the often low concentrations of the molecules in the gas phase, which inhibits the use of optical absorption for the measurement of spectra. In such a case, photofragmentation spectroscopy can be used to determine molecular absorptions and hence obtain structural information about molecules. This involves single or multiple photon dissociation of molecules in the gas phase by infrared (IR), visible (Vis), and/or ultraviolet (UV) (which includes vacuum ultraviolet (VUV)) radiation from a laser or non-laser light source. Another challenge with large, non-volatile molecules is bringing them into the gas phase for analysis. However, numerous reliable and convenient techniques have been developed in recent years in conjunction with mass spectrometry. These include converting the molecules to ions using an ionization technique, for example electrospray ionization.

The technique of mass spectrometry, which analyzes ions on the basis of their mass-to-charge ratio (m/z), permits recording a mass spectrum of ions and also their fragments. High resolution instruments, which include Fourier transform mass spectrometry (FTMS) instruments, such as those having an Orbitrap™ mass analyzer from Thermo Scientific or ion cyclotron resonance (ICR) mass analyzer, and time-of-flight (TOF) instruments, provide resolution sufficient to distinguish charged peptides by observing their isotopic distributions. Coupled with high dynamic range and m/z accuracy, this has resulted in mass spectrometry becoming a primary technique for the analysis of proteins and peptides, along with others such as nuclear magnetic resonance (NMR) and X-ray crystallography.

A fundamental limitation of mass spectrometry, however, is that it relies solely on measuring the mass and charge of ions and their fragments, but often provides only limited information on the conformational arrangement or other structural arrangement of atoms in the molecules. Complementary techniques based on ion drift in gas, like ion mobility spectrometry (IMS) or field-asymmetric IMS (FAIMS), provide only very limited additional information on molecular structure.

It is known to measure photofragmentation mass-spectra based on a fixed wavelength UV/VUV laser/non-laser light source, e.g. VUV photofragmentation of proteins and peptides in the MS/MS top-down approach (see J. S. Brodbelt, Chemical Society Reviews 43 (8), 2757 (2014); and J. Lemoine, T. Tabarin, R. Antoine, M. Broyer, and P. Dugourd, Rapid Communications in Mass Spectrometry 20 (3), 507 (2006)). This approach allows for a drastic increase in a variety of fragments and their yield, facilitating protein identification. In particular, VUV excitation, typically by ArF or KrF excimer lasers, results in cleavage of peptide bonds and high abundance of characteristic b and y fragments. All these studies employ lasers with a fixed wavelength. In a recent patent publication, WO 2013/005060 A2 discloses photodissociation as a method of fragmentation in mass spectrometry, specifically in an $MS^n$ approach for peptide sequencing. However, structural information such as conformational/isomeric arrangement is usually not provided by this approach.

Accordingly, there remains a need to improve the analysis of large molecules, such as large biomolecules and their clusters, and their interactions, e.g. the binding of drugs to target peptides. In particular, it is desirable to provide an improved means for structural, e.g. conformational and isomeric, identification of such molecules and their mixtures. Achieving this is difficult with existing techniques due to the complexity of both the biomolecular systems involved and the corresponding experimental approaches.

In view of the above background, the present disclosure is made.

SUMMARY

According to an aspect of the present disclosure there is provided a method of analyzing molecules comprising:

generating ions from a sample of molecules to be analyzed;

fragmenting at least some of the ions by irradiating the ions sequentially with light at a plurality of different wavelengths (λ) within one or more predetermined spectral intervals;

recording a fragment mass spectrum of the fragmented ions comprising a detected signal (I) versus m/z over a predetermined range of m/z values for each of the plurality of different wavelengths (λ), thereby recording a two-dimensional dependency of the detected signal (I) on m/z and irradiation wavelength (λ); and determining from the recorded two-dimensional dependency an identity of at least one of the molecules and/or relative abundances of different molecules in the sample.

According to another aspect there is provided an apparatus for analyzing a sample of molecules, comprising:

an ion generator for generating ions from the molecules;

an ion trap downstream from the ion generator for receiving the generated ions, wherein the ion trap is preferably configured to be cooled to a trap temperature below ambient temperature and filled with gas that is non-condensing at the trap temperature for cooling the ions;

a light source for irradiating the preferably cooled ions with light to cause fragmentation of the ions thereby forming fragment ions, wherein the wavelength of the light can be varied; and a mass analyzer for mass analysis of the fragment ions, wherein the mass analysis is configured to analyze a plurality of fragment ions in parallel.

Further features are described in the appended claims and in more detail below.

Various embodiments can be seen as based upon a two-dimensional measurement of the abundance of ions derived from the molecules, i.e. the measurement of the abundance of ions as a function of the mass-to-charge ratio of the ions and as a function of the wavelength of light used to cause or modify fragmentation of ions. This provides a three-dimensional data array or data matrix comprising a detected ion signal recorded against mass-to-charge ratio of the ions and against wavelength of light used to irradiate the ions (i.e. the ion signal detected for a given wavelength of light is recorded for a plurality of mass-to-charge ratios and the ion signal for a given mass-to-charge ratio is recorded for a plurality of wavelengths of light), which can be numerically analyzed (e.g. by mathematically decomposition) and/or compared to a library of previously acquired data in order to enable the chemical, structural and conformational identification (i.e. isomeric identification) of molecules in a sample and/or the determination of their relative abundances.

Combining optical spectroscopy of ions with panoramic m/z range MS, in particular with FTMS or TOF MS, creates a unique method for structural and isomeric identification of ions in the gas phase. The disclosure enables measurements of two-dimensional photofragmentation-MS fingerprints of molecular ions. Each fingerprint is extremely specific to a particular molecule or ion. In particular embodiments, it enables measurements of vibrationally resolved two-dimensional photofragmentation-MS fingerprints of large ions, such as ionic biomolecules and biomolecular clusters, and allows for improved determination of their photodissociation pathways. These features are useful for enabling, for example, determination of the structure and interactions of molecular complexes with medical or pharmaceutical relevance, such as the binding of drugs to target peptides, water solvation of peptides and peptide drugs and peptide aggregation relevant to diseases such as amyloid diseases. A general objective in this field is to provide information about binding sites, complex structure and/or the dynamics of complex formation.

Embodiments of the disclosure can be implemented as a fast technique. For example, the molecules to be identified may be present in the eluent from a chromatographic apparatus and, within the width of a chromatographic peak, the ion abundance can be recorded both as a function of the mass-to-charge ratio and as a function of the wavelength of light causing fragmentation. Various embodiments can therefore provide a fast technique for the identification of multiple molecules in a mixture, in particular wherein the molecules being analyzed are changing with time (e.g. as in a sample of molecules that is being separated by chromatography).

The combination of optical spectroscopy and wide mass range or panoramic mass spectrometry measurements allows for significant improvements in the throughput of analyzes and in the specificity of analysis. For instance, molecular species with the same or similar (isobaric) masses, e.g. isomers, may be difficult to resolve with mass spectrometry alone, whereas the present disclosure enables identification of such isomers, including conformers, using a wide mass range mass spectrometry measurement in combination with an optical spectroscopy measurement. A plurality of molecules can be identified at the same time with the same two-dimensional analytical measurement. Various embodiments are particularly useful for identifying large biomolecules and their clusters. It can be used for identifying their isomers, as well as their interactions, e.g. the binding of drugs to target peptides.

Further features and advantages of the disclosure will now be described in more detail, including preferred embodiments. Particular preferred features are contained in the appended claims.

DETAILED DESCRIPTION

Herein the term 'infrared (IR)' refers to the near-IR, mid-IR and far-IR regions, unless stated otherwise.

Herein the term 'ultraviolet (UV)' refers to the near-UV, mid-IV and vacuum UV regions, unless stated otherwise.

Herein the term 'UV/IR' spectroscopy refers generally to UV, visible and/or IR spectroscopy.

Herein the term 'molecule' refers to both single molecules and molecular entities, e.g. clusters, comprising two or more molecules. Aspects of the disclosure preferably applicable to the identification and/or quantitation of molecules having a molecular mass less than 2 kDa.

Herein the term "mixture of molecules" refers to different molecules and molecular entities, including different isomers (e.g. conformers) of the same molecule, that may be subjected to analysis simultaneously, for example due to their co-elution following LC or GC or any other separation. As the number of isomers for some molecules could reach hundreds, it is often not possible to separate all of them from each other by any one of such separation techniques.

The identification of a molecule in a sample proceeds from identification of the ion or ions in the gas phase derived from the molecule. The identification may comprise any number of the following:

a) identification of the chemical formula of an unknown ion;

b) identification of the functional group(s) of an unknown ion;

c) identification of the structural formula of an unknown ion;

d) identification of the three-dimensional (3D) structure of an unknown ion.

In the case of a mixture of molecules (including different isomers (conformers) of the same molecule) subjected to analysis, the identification may also comprise:

a) identification of one or a plurality of ion species and their relative abundances (concentrations) in a mixture of ions;

b) identification of the number of the most populated isomers of the same ion; and c) identification of the structure of the most populated isomers (conformers) of the same ion.

The molecules must first be converted to the gas phase such that gas phase ions are generated. The ion generator is preferably an ion source known in the art of mass spectrometry. A preferred ion generator is an electrospray ionization (ESI) source, but other atmospheric pressure ionization (API) sources may be used and ionization may be performed by methods such as electron impact (EI) ionization and other techniques. The ions may be brought to the gas phase as protonated molecular ions, e.g. protonated peptides, by an ESI source, for example. The gas phase ions are brought into a vacuum environment of the apparatus.

An optional, but preferred, next stage may further comprise selecting on the basis of some physico-chemical property of a sub-set of the generated ions before fragmenting the ions whereby only the selected sub-set are irradiated, e.g. so that only ions of a restricted predetermined m/z range or ion mobility range are subsequently fragmented. Such selection by an ion selector could take place in a vacuum region of the apparatus. The sub-set of the generated ions may be selected according to mass-to-charge ratio, or ion mobility, or other physico-chemical parameter. This is a selection of ions that may be performed in addition to any optional pre-selection of the molecules before generation of the ions, e.g. by chromatography upstream. The apparatus thus preferably further comprises a mass selector downstream of the ion generator for mass selecting the generated ions. The selection according to mass-to-charge ratio is preferably performed by a multipole mass filter, preferably a transmission quadrupole mass filter, or by a mass selective ion trap, or by another suitable filter or lens. Most preferably, the mass-filter (e.g. quadrupole mass filter) is tuned to transmit only ions of a specific m/z value or narrow m/z range. In embodiments where the selection is according to ion mobility, an ion mobility separation device is preferably located downstream of the ion generator for this purpose.

The generated ions of interest, optionally the selected sub-set thereof, are preferably transferred to an ion trap downstream of the ion generator. This ion trap is an RF or electrostatic device suitable for ion capture and storage, but preferably is a linear RF multipole trap (quadrupole and higher), including a flat ion trap, ring electrode ion trap, or a 3D quadrupole trap (Paul trap). The as-yet unfragmented ions introduced into the ion trap are herein referred to as precursor ions. The ion trap is held at a vacuum. The optional mass selector is preferably located upstream of the ion trap. The ion trap may serve numerous functions. The ions may be stored in the ion trap. The ions may be cooled in the ion trap.

Various embodiments further comprise cooling the generated ions below ambient temperature before fragmenting the ions, optionally cryogenically cooling the ions. In such preferred cases, the precursor ions are preferably cooled in the ion trap, more preferably cryogenically cooled (e.g. to a temperature below 20K, such as 10-20 K for instance). For this purpose, the ion trap is preferably configured to be cooled to a temperature below ambient temperature and contains a gas that is non-condensing at the trap temperature. This so-called cooling gas preferably is pulsed into the trap through a pulsed molecular valve. The gas is pulsed typically 0.1-1 ms before the arrival of the ions to the trap, and typically at least 10-20 ms prior to the first light pulse. The peak pressure of cooling gas in the ion trap is typically 0.5 mbar. The cooling gas is usually cooled through collisions with the walls of the ion trap. Thereby the ions may cool through collisions with the cooling gas. The cooling substantially reduces all of the ionic species in the ion trap to their ground vibrational quantum state. This greatly suppresses the thermal congestion in the spectrum and allows for vibrational resolution in UV and IR spectra. The cooling also reduces the conformational heterogeneity of the ionic species in the ion trap, enabling their conformer-selective excitation by UV/IR light.

The precursor ions, preferably the cooled ions, are next fragmented. The ions are preferably fragmented, at least photofragmented, in the ion trap. The irradiation preferably occurs while the ions are in the ion trap. For this purpose, one or two optical windows are provided in the apparatus such that the light may be directed through the one or two windows into the ion trap, preferably along the trap axis.

Various embodiments preferably comprise fragmenting the precursor ions by irradiating the ions to cause photofragmentation of the ions (e.g. direct photofragmentation) and/or photoactivation of the ions, optionally followed by causing collisions with a gas and/or further irradiation (preferably with IR light, especially IR laser light) to increase the yield of fragmentation. Any other additional method of fragmentation could be used, for example, electron transfer dissociation, electron capture dissociation, etc.

The collision cell is preferably located downstream of the optional mass selector. In certain embodiments, therefore, various embodiments may comprise single or multiple photon activation of the ions in the gas phase through absorption of IR, visible or ultraviolet (UV) (which includes vacuum ultraviolet (VUV)) radiation from a laser or non-laser light source with subsequent dissociation using another IR, Vis or UV light source, and/or using collisions of the photoactivated ions with neutral buffer gas molecules.

Optionally, photofragments can be mass selected, for example by ejecting the fragments from the ion trap and mass selecting fragments by their m/z using a mass selector, or by mass selecting the fragments in the ion trap. In the latter case, the ion trap is preferably a linear or a 3D quadrupole ion trap and the mass selection is performed by ejecting the undesired fragments. The mass selected fragments may be provided to the mass analyzer or subjected to further fragmenting either in the ion trap (photofragmentation) or in another device (e.g. collision cell, ETD cell etc.) to provide an $MS^n$ approach. In a preferred embodiment, photofragments of a selected m/z (e.g. the same m/z) or m/z range are isolated in the ion trap and subsequently fragmented (optionally photofragmented) to produce secondary fragments (optionally secondary photofragments). In a pseudo $MS^n$ approach it is possible to continue fragmenting the overall ion population in the ion trap after a first fragmentation has been effected to produce secondary photofragments, and/or tertiary photofragments etc. The secondary photofragments may be mass analyzed in the mass analyzer at each of a plurality of irradiation wavelengths, e.g. to measure the two-dimensional dependency of the detected signal (I) against m/z of the secondary fragments and irradiation wavelength ($\lambda$).

The process of irradiating the ions preferably comprises irradiating the ions with UV, visible and/or IR light, more preferably from a laser. Preferably, the process of irradiating the ions comprises irradiating the ions at least with UV light, more preferably UV laser light.

The process of irradiating the ions may comprise irradiating the ions with light from two or more light sources of different wavelength, optionally two or more lasers. The ions are preferably irradiated with the light from the two or more light sources wherein one light source is configured to begin irradiating the ions shortly before the other light source (including a case of simultaneous irradiation). Preferably, one light source has a fixed wavelength to fragment a molecule and another light source has a tunable wavelength to modify a fragmentation yield of the molecule. Preferably, the process of irradiating the ions comprises irradiating the ions with fixed wavelength UV light and tunable IR light, in particular a fixed wavelength UV laser and a tunable IR laser. Herein the term laser is intended to include devices that produce laser light, such as an optical parametric oscillator (OPO). Alternatively, the process of irradiating the ions could comprise irradiating the ions with fixed wavelength IR light and tunable UV light. Thus, the light source of the apparatus preferably comprises two or more light sources for sequentially irradiating the ions, a first light source for causing fragmentation of the ions and another light source for modifying the fragmentation caused by the first light source. The light source may comprise two or more light sources for sequentially irradiating the ions, wherein at least one light source is tunable, and optionally wherein two light sources are tunable.

Optionally, the ions may be irradiated by a plurality of pulses of the light of the same or different wavelength, per each load of the ion trap. For example, several UV photofragmentation pulses of the same wavelength may be used per each load of the ion trap. While the first pulse largely results in fragmentation of the precursor ions thereby forming primary photofragments, the subsequent pulses may increase fragmentation yield, but also cause the secondary, tertiary, etc. fragmentation of the primary photofragments, thus providing additional structural information about the precursor ions. This multi-pulse approach is similar to the $MS^n$ approach, which uses photofragmentation. In such cases, the whole photofragment mass-spectrum (of primary and any secondary, tertiary, etc. photofragments) is preferably recorded at each irradiation wavelength as a function of the number of pulses between 1 and N, where N is the predetermined maximum number of pulses per load of the trap. Such a cycle of N measurements has to be repeated at each wavelength within the predetermined spectral interval (s). Finally, the resultant collection of N 3D data arrays can be analyzed to identify the structure of the molecules, e.g. using appropriate mathematical algorithms.

It is possible that certain molecules, such as large peptides, may not undergo efficient UV fragmentation. In such cases, the fragmentation yield can be increased by further energizing the photoactivated ions (e.g. the UV-IR pre-excited ions) through collisions with buffer gas molecules (as with the collision cell described above), or by further irradiation with light, preferably IR laser light, or both. Any other additional method of fragmentation could be used, for example, electron transfer dissociation (ETD), electron capture dissociation (ECD), etc. Such a combined approach to fragmentation advantageously may generate certain fragments, which are specific to UV excitation, but which are not present in collision-induced or UV-induced dissociations.

For the purpose of increasing the yield of fragmentation, the apparatus may further comprise a collision cell for receiving ions that have been photofragmented and/or photoactivated by the irradiation with light, wherein the collision cell is configured to be provided with neutral buffer gas to increase a yield of the fragmentation by collisions of photoactivated ions with the buffer gas. The pressure in the collision cell containing buffer gas is typically $10^{-3}$-$10^{-2}$ mbar. The collision cell is preferably located at a position that is between the ion trap and the mass analyzer.

In certain embodiments, therefore, various embodiments may comprise single or multiple photon activation of the ions in the gas phase through absorption of IR, visible or UV radiation from a laser or non-laser light source with subsequent dissociation using another IR, Vis or UV light source, and/or using collisions of the photo-activated ions with neutral buffer gas molecules.

The recording of the fragment mass spectrum is preferably performed using one of the following: an ion trap mass analyzer (e.g. a multipole ion trap mass analyzer, such as a 3D or linear ion trap mass analyzer), an orbital trap mass analyzer (especially an FT electrostatic orbital trap mass analyzer, such as an Orbitrap mass analyzer), FT-ICR mass analyzer, or a TOF mass analyzer (preferably a single or multiple reflection TOF, or a multi-turn TOF) or any other suitable mass analyzer. High-resolution accurate-mass (HR-AM) mass analyzers are preferred, such as an Orbitrap mass analyzer. The mass analyzer is typically held at high vacuum, the preferred pressure depending on the type of analyzer as known in the art.

The mass analysis comprises introducing the ions to be analyzed into the mass analyzer and detecting the ions in the mass analyzer. The mass analyzer is preferably of a type for receiving and trapping ions therein and for causing the ions to undergo periodic motion, e.g. to oscillate (which term herein also encompasses motion that is rotational) within the mass analyzer. Preferably, the oscillation of the ions in the mass analyzer is detected by image current detection. Such detection is preferably provided by an electrostatic trap mass analyzer, such as an orbital trap. Preferably, the pressure in the mass analyzer is not greater than $1\times10^{-8}$ mbar, preferably not greater than $5\times10^{-9}$ mbar, more preferably not greater than $2\times10^{-9}$ mbar, and even more preferably not greater than $1\times10^{-9}$ mbar.

Preferably, the ion trap is linked to the mass analyzer and/or the ion generator and/or the collision cell via bent ion optics. The bent ion optics are preferably such that there is no direct line of sight between ions trapped in the ion trap and an exit from the bent ion optics (the exit being the end of the ion optics that the ions leave from when travelling away from the ion trap). The bent ion optics preferably comprise at least one bent RF-only multipole or at least one electrostatic ion bending device, preferably wherein the RF-only multipole or electrostatic ion bending device is bent such that there is no direct line of sight between ions trapped in the ion trap and an exit from the RF-only multipole or electrostatic ion bending device. The ion trap is preferably located at the end of an ion optical path (the path followed by the ions through the apparatus), further preferably downstream of the bent ion optics.

The bent ion optics (preferably at least one RF-only multipole or at least one electrostatic ion bending device) preferably allows the light source (including at least one of the light sources where there are at least two sources) to freely irradiate ions in the ion trap from both entrance and exit sides through the RF-only multipole or electrostatic ion bending device.

The apparatus preferably comprises a controller that preferably comprises a computer together with associated control electronics, which is programmed for example to control light pulses, the generation and introduction of ions in the described manner, as well as the described steps of trapping and fragmentation of ions, and applying the necessary voltages to the electrodes of the ion trap, ion optics, mass selector, and collision cell and to control the vacuum pumping to attain the specified pressures.

The apparatus preferably comprises a data acquisition system for receiving the output of the mass analyzer, i.e. the detected signal (I), and recording a fragment mass spectrum from the mass analysis, the fragment mass spectrum comprising a detected signal (I) versus m/z over a predetermined range of m/z values, for each of a plurality of different wavelengths ($\lambda$) of the light, thereby recording a two-dimensional dependency of the detected signal (I) on both m/z and irradiation wavelength ($\lambda$). The data acquisition system preferably comprises a data processor, such as a computer, to receive and process the signal from the mass analyzer and the information on the wavelength of the scanned light and preferably comprises data storage, e.g. to store the mass fragment spectra and the wavelength data array (i.e. the 3D data array). Preferably, the data acquisition system is for identification of molecules in the sample from the two-dimensional dependency of the detected signal (I) on m/z and irradiation wavelength (λ) and/or determining relative abundances of different molecules in the sample. Such identification may be performed on the processor or computer of the system. The mathematical decomposition of the three-dimensional data array and/or the comparing to a library of previously acquired data may be performed by the data acquisition system, e.g. by the processor or computer thereof. Alternatively, the processing required for identification of molecules in the sample may be carried out remotely from the apparatus on a separate data system, e.g. separate computer. The data acquisition system and the controller may comprise the same computer, or different computers.

According to various aspects, a two-dimensional analysis comprises a simultaneous measurement of the relative abundances, in terms of a detected signal (I), of at least some (i.e. more than one), preferably all, ion fragments produced by irradiation of gas-phase ions, the simultaneous measurement of fragments being performed at each of a plurality of wavelengths within a predetermined spectral interval. Thus, in preferred embodiments, the simultaneous measurement of the relative abundances of the ion fragments is performed as the wavelength of irradiation is scanned, preferably by changing the wavelength in discrete, predetermined spectral steps. The magnitude of the spectral step within the predetermined spectral interval may be either the same across the spectral interval, or it may change across the spectral interval. The wavelengths may be across one continuous predetermined spectral interval, or may be across two or more discontinuous spectral intervals. The output of such a measurement generates a three-dimensional (3D) set of data (3D data array or matrix): or a two-dimensional (2D) spectrum: i.e. i.e. ion abundance versus wavelength (λ) and m/z, which can be used for determining the identity and/or relative abundances of the molecules. This is in contrast to the prior art, e.g. as disclosed in WO 2013/005060 A2, which doesn't involve the use of 3D data or spectra and doesn't use the spectroscopy for structural or conformational determinations of molecules.

Methods of vibrational activation of ions, such that collisional induced dissociation, high-energy collisional dissociation, IR (for non-covalently bonded complexes) and IR multiple photon dissociation produce statistical fragments only, which correspond to the cleavage of the weakest bonds of an ion. In addition to these statistical fragments, UV fragmentation may produce some non-statistical "prompt" fragments (or elevated abundance of statistical fragments), resulting from excitation of electronic excited states of an ion. The known "prompt" fragments are, for instance, those, which correspond to a loss of side-chains of aromatic residues (Trp, Tyr, Phe) and phosphotyrosine in peptides and proteins upon their UV excitation, as described in the article by Kopysov, V. et al, JACS, 136 (26), 9288 (2014), and their presence and abundance can be influenced by 3D structure of a peptide. This makes UV photofragmentation, in particular, sensitive to isomeric (conformational) structure of ions and can be employed for structural identifications.

It is known in the art of spectroscopy that UV spectra are very sensitive to fine structural changes around the absorbing chromophore in molecules and molecular ions. In conjunction with the m/z measurements on the mass analyzer, which is preferably a high m/z resolution mass analyzer, the spectral measurements, which are preferably vibrationally resolved, provide a large number of features in the recorded three-dimensional data array, making it a unique fingerprint of the ions being analyzed. The fingerprint reflects the energies of vibronic transitions, which are fundamental to an ion on a quantum-mechanical level and, therefore, can be reproduced from experiment to experiment with spectroscopic accuracy. The fingerprints utilized are preferably fingerprints of the ions at a temperature below ambient and most preferably at cryogenic temperature (20 K or below, typically 10 to 20 K).

The 3D fingerprinting may be particularly useful for identifying at least one of the molecules and/or determining relative abundances of different molecules in the sample. The molecules can differ by their chemical composition or by their 3D structure (e.g. isomers, including conformers). Preferably, the process of determining the identity and/or relative abundances of molecules comprises comparing the recorded two-dimensional spectra against a (previously acquired) library of the fingerprints of known molecules. In other words, the recorded two-dimensional dependency of the detected signal (I) may be compared against a (previously acquired) library of two-dimensional dependencies of detected signals (I) on m/z and irradiation wavelength (λ) acquired from fragmented ions of known molecules in order to identify and/or determine relative abundances of different molecules in the sample.

The 3D fingerprinting of peptides is seen as particularly useful in de novo sequencing of proteins, while 3D fingerprinting of certain functional groups or moieties (e.g. phenyl, benzyl, alkyl, ester, etc.) could be useful for the profiling of small metabolites and in solving 3D structures of drug molecules with unknown chemical structures, which include many aromatic drug molecules and metabolites.

The prior art, e.g. as disclosed in WO 2013/005060 A2, doesn't disclose the use of a library of two-dimensional dependencies of detected signals (I) on m/z and irradiation wavelength (λ) for known molecules in order to identity and/or determine the relative abundances of molecules in a sample.

The generation of an exhaustive library is an important pre-requisite for success of this approach and reference spectra can be implemented for each individual well-defined compound (standard) separately and within different classes of compounds (e.g. the metabolites related to a certain biological process, peptides with post-translational modifications, etc.). The library spectra are preferably generated under conditions close to those during the actual measurement of unknown molecules or mixtures of molecules. The library could be stored on-board the mass spectrometer, or on an application computer, or on a server, or on a cloud (e.g. like the so-called m/z Cloud library). In the simplest case, a similarity score (e.g. dot-product) could be used to determine the best fit of the measured molecules to the library. More sophisticated algorithms (e.g. non-negative least squares optimization or cluster analysis or neural network models) can be used to determine the presence of library-stored fingerprints in the measured spectrum and the relative abundances (concentrations) of the molecules thus found in the sample.

It will be appreciated that to obtain the most accurate fingerprints, the measured two-dimensional spectrum (i.e. intensity (I) vs m/z and λ) should be normalized to the total number of ions. Ideally this should be the initial number of precursor ions to be fragmented. Alternatively, as a good approximation to this, the two-dimensional spectrum can be normalized to the total ion current (TIC) detected. The method thus preferably further comprises normalizing the recorded two-dimensional spectrum to the total number of precursor ions or to the total ion current detected by the mass analyzer. Fingerprints in the library of fingerprints are preferably normalized fingerprints that have been normalized in such way. Thus, comparing a normalized spectrum with normalized library fingerprints is preferred. Various embodiments are preferably implemented with mass analyzers that measure a plurality (e.g. all) of fragment ions (and remaining precursor ions) in parallel such as FTMS, TOF, ion traps and Orbital trapping mass analyzers, which permit such global normalisation of the entire two-dimensional spectrum since all ions detected in the same measurement cycle (trap fill and irradiation). With prior art mass analysis of photofragmented ions by a quadrupole mass analyzer, each fragment is detected from, in general, different number of parent ions, which cannot be detected in the same cycle of measurements. This makes normalization, in general, less accurate.

Various embodiments can be used for analysis of a sample of molecules, comprising two or more isomers, in particular conformers, to determine the number of the isomers and/or their relative abundances. In such case the determining step preferably comprises mathematically decomposing the matrix, representing the measured three-dimensional data array, to pairs of vectors, wherein each pair represents a different isomer of the same molecule. One vector of each pair corresponds to a signal I versus λ spectrum, i.e. absorption spectrum, of the isomer represented by that pair and the other vector of each pair corresponds to a signal I versus m/z spectrum, i.e. fragmentation mass spectrum, of the isomer. The outer product of each pair of vectors, that represents a certain isomer, is a matrix of the same size as the measured one. Therefore the measured matrix can be decomposed in a linear combination of the outer products of each pair of vectors, wherein the scalar coefficients of such decomposition represent the relative abundances of the different isomers. This decomposition can be done, for instance, using a singular value decomposition (optionally non-negative singular value decomposition) procedure with subsequent alternating least squares analysis. Other mathematical methods, e.g. non-negative matrix factor analysis, could also be used.

Such a mathematical approach can also be used for the analysis of a sample of chemically different molecules, for which the 3D fingerprints were not previously obtained, to determine the number of different compounds although without their identification.

The mathematical analysis of the three-dimensional data array allows for extracting optical and photofragment spectra of individual conformers from the three-dimensional data array, measured in a single experiment. The method preferably comprises comparing one or more of the pairs of vectors to one or more calculated pairs of vectors that have been calculated for one or more candidate molecular structures and from the comparison (e.g. based on an evaluated best match) for a pair of vectors selecting a candidate molecular structure as the most likely structure of the molecule in the sample. The mathematically decomposed pairs of vectors may be used for selecting and validating a calculated 3D (e.g. conformational) structure of the molecule from a number of candidate calculated 3D (e.g. conformational) structures through comparing the decomposed pairs of vectors and calculated pairs of vectors (calculated for the candidate calculated 3D structures).

The process of determining the identity and/or relative abundances of molecules thus preferably comprises mathematically analyzing the recorded two-dimensional dependency of the detected signal (I) to identify at least one of the molecules and/or determine relative abundances of different molecules in the sample.

In preferred embodiments, when the gas-phase ions are cooled in the ion trap to the temperature well below ambient, more preferably when the ions are cryogenically cooled, the recognition of specific photofragmentation patterns in the recorded 2D spectra may provide information on the presence of certain functional groups (e.g. amino-, hydroxyl-, phospho-, etc.) or moieties (e.g. phenyl-, benzyl-, benzoyl-, etc.). The 3D fingerprinting of peptides is seen particularly useful in de novo sequencing, where a confident identification of one or several amino acids in peptide sequence substantially simplifies the subsequent elucidation of its primary structure. This can also be useful in the field of metabolomics, when a sample to be analyzed may typically comprise thousands of different molecules. In this particular case determination of the elemental composition, provided by high-resolution mass spectrometry, together with identification of functional groups may allow for identification of structural formulas of lots of metabolites during a single scan.

Although UV spectra are very sensitive to the local environment of the chromophore, they do not contain structural information of the whole molecule. In contrast, IR spectra directly reflect frequencies of all vibrational modes of a molecule and they, therefore, are the most suitable spectra for validating calculated 3D structures of molecules and ions. In this way, IR-UV double resonance is known as a technique for measuring conformation-selective IR spectra of molecules and ions at very low concentrations. When a UV photodissociation spectrum is vibrationally resolved, it is possible to tune a UV laser to a peak that belongs to one particular conformer. The preceding pulse of tunable IR light will then modify the photofragmentation yield only if it excites the same conformer. These modifications can be detected, yielding an IR absorption spectrum of this conformer. However, this approach fails if the UV spectrum is congested or broadened. In contrast, the two-dimensional spectroscopy of the present disclosure allows obtaining conformer-selective IR spectra, regardless of this, provided the UV-MS fingerprints of different conformers are not fully identical. In preferred embodiments, the measurements may be made with a UV laser fixed at a wavelength to the red (preferably slightly to the red) from the UV band origin. The preceding IR pulse broadens the spectrum, inducing the subsequent UV absorption-fragmentation. The measured 3D spectrum can be decomposed to IR spectrum and fragment mass spectrum pairs. Each pair then can serve as a benchmark to constrain and/or validate 3D structural calculations.

The method may further comprise, preferably together with cooling of the generated ions below ambient temperature before fragmenting the ions, tuning the wavelength of IR (optionally UV) light to selectively excite one or more molecular bonds of an isotopically labelled molecule. This is based on the phenomenon called "isotopic shift". Isotopic labelling changes the frequency of those vibrations in which a labelled atom is involved (e.g. O—H stretch is 3700 $cm^{-1}$, whereas O-D is 2700 $cm^{-1}$, i.e. an isotopic shift of ~1000 $cm^{-1}$). This phenomenon allows for selective fragmentation of either an original molecule or its labelled analogue using the IR-UV technique described above. The resultant fragments may contain charged fragments containing the labelled atom.

One or more of the following molecular bonds can be excited by IR light:

i. a bond to an isotopic label in an isotopically labeled molecule, optionally a label containing $^{2}D$, $^{13}C$, $^{15}N$, $^{18}O$, etc. or any combination thereof;

ii. a bond to a functional group or moiety in an organic molecule, optionally one of: hydrocarbyls, halogen-, oxygen-, nitrogen-, sulfur-, phosphorus-, iron-, selenium-containing groups iii. a bond to a functional group in an organic polymer, optionally wherein the group is a phosphorylation or glycosylation group etc., optionally wherein the molecule is a peptide, or protein, or DNA, or RNA, or modified peptide, or modified protein, or modified DNA, or modified RNA, optionally wherein the modified peptide or protein is post-translationally modified;

iv. a bond in a linker in a cross-linked peptide, or protein, or a complex thereof, or DNA, or RNA, optionally wherein the bond is a disulfide bond or the linker is an artificially introduced linker;

v. a non-covalent bond in a peptide, protein or a complex thereof, optionally wherein the non-covalent bond is a hydrogen bond, optionally wherein the complex is a complex of the peptide or protein with one or more water molecules.

Detection of IR absorption bands due to excitation of such specific molecular bonds can be used for identification of the respective species.

Various embodiments provide a three-dimensional data array or data matrix comprising a detected ion signal recorded against mass-to-charge ratio of the ions and against wavelength of light used to irradiate the ions (i.e. the ion signal detected for a given wavelength of light is recorded for a plurality of mass-to-charge ratios and the ion signal for a given mass-to-charge ratio is recorded for a plurality of wavelengths of light). The data array, which records a two-dimensional dependency of the detected signal (I) on m/z and irradiation wavelength (λ), can be mathematically analyzed and/or compared to a library of previously acquired data in order to enable determination of a molecular identity and/or relative abundances of different molecules.

There are many publications on the measurement of UV and IR spectra by detecting one or a few photofragments and for the use of the spectra for certain structural determinations. However, it would be unrealistically time consuming to use the prior art methods to measure the spectra for every mass over a wide mass range, especially where high-resolution mass spectra are required. Therefore, the prior art approach cannot be interfaced online to modern analytical separation techniques (e.g. high- and ultra-high performance liquid chromatography (LC), capillary electrophoresis (CE), nanoscale LC, gas chromatography (GC), ion chromatography (IC), ion mobility (IMS), etc.) without a loss of mass-spectrometric information. In contrast to this, aspects of the present disclosure allow for interfacing the analysis to such separation techniques and offer a dramatic increase in the throughput and specificity of analysis. As each mass spectrum is acquired over a broad mass range and with high resolution and mass accuracy, a two-dimensional spectrum may be measured over the same length of time as a conventional one-dimensional optical spectrum corresponding for the same spectral range for a single ion species, although aspects of the present disclosure contain information on all species present (i.e. molecules, their isomers etc.). The method is therefore much faster than a conventional approach would be for acquiring the same amount of information. Also, compared with a one-dimensional optical spectrum, the method is more accurate in measuring relative abundance of photofragments, because all the fragments are measured at once and together with the precursor ion.

Due to the speed of the analysis, it finds application in particular to the analysis of samples that are changing with time, such as samples emanating from a separation technique. Accordingly, in a preferred type of embodiment, the sample of molecules is a mixture of molecules and the method comprises, preferably before generating the ions, causing the mixture to flow and subjecting the flowing mixture to a separation process whereby different molecules in the flow become separated in time and the flow of molecules goes through at least one maximum. The separation process may be a method of chromatography, e.g. liquid or gas chromatography, and the maximum thus may be a chromatographic peak. The chromatography may be, for example, HPLC, UHPLC, capillary electrophoresis (CE), nanoscale LC, gas chromatography (GC), or ion chromatography (IC). The method may be applied where a separation technique is applied to the ions after the ions have been generated, such as separating the ions by ion mobility (IMS) e.g. after causing the ions to flow. The maximum in the flow thus may be an ion mobility peak. Advantageously, the duration of recording the two-dimensional dependency of the detected signal (I) on m/z and irradiation wavelength (λ) is not longer than the full width of the maximum for a molecule or ion of interest.

Thus, the apparatus for such embodiments may be connected to a chromatographic apparatus and the sample is contained in an eluent from the chromatographic apparatus and wherein the light source and mass analyzer are configured to operate such that for each chromatographic peak of interest the mass analysis of the fragment ions is conducted at each of a plurality of wavelengths of the light (λ), thereby enabling a two-dimensional dependency of a detected signal (I) of the mass analyzer on m/z and irradiation wavelength (λ) to be recorded for that chromatographic peak.

It should be noted that there is no requirement that λ should change monotonically when scanning. On the contrary, in some cases it is preferable to sample at non-sequential values of λ or use pre-defined pseudo-random sequences. It is also preferable to omit altogether information-poor or redundant regions of the λ spectrum.

It is possible for one or more experimental conditions of the method to be selected on the basis of previously acquired data and/or upon fulfillment of one or more pre-determined conditions. The data acquisition system may be used to select the conditions based upon the previously acquired data (i.e. spectra) and/or upon fulfillment of one or more pre-determined conditions. For example, the experimental conditions to be selected may comprise: the selection of a sub-set of ions for fragmentation, the irradiation wavelength, conditions of mass analysis (e.g. number of scans, m/z range, mass resolution, mass accuracy), use of collision cell, and collision cell parameters (e.g. collision energy, buffer gas pressure).

Figure 2:
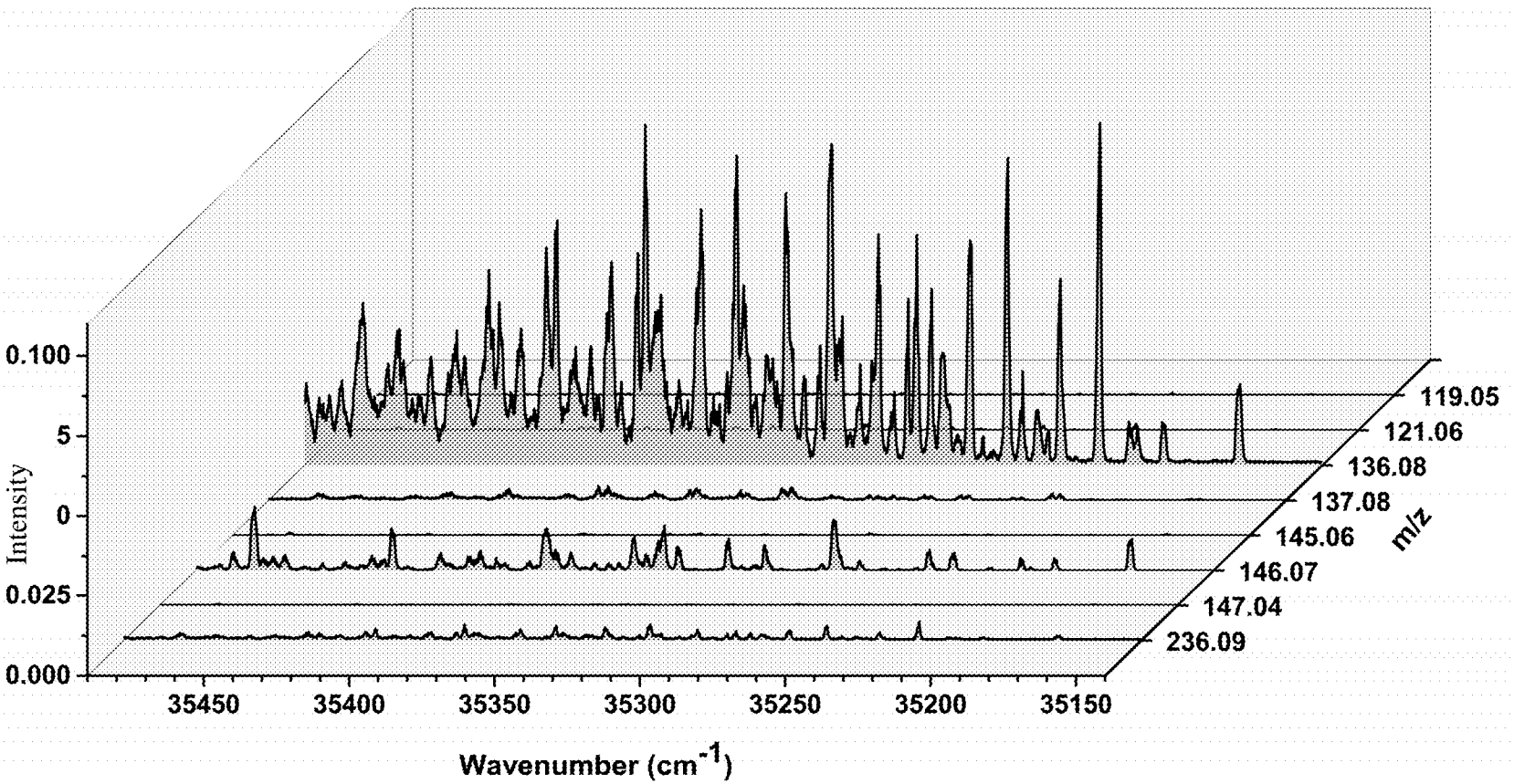
FIG. 2 shows an example of a 3D data array (signal (I) vs λ and m/z) of the $[YA-H]^{+}$ dipeptide measured by scanning the wavelength of the UV excitation laser while monitoring all appearing photofragments with the Orbitrap mass-analyzer.

of the three most abundant conformers of the $[YA-H]^+$ dipeptide that have been mathematically extracted from the 3D data array, partially shown in FIG. 2. The spectrum, which reflects reduction of the precursor ions due to UV irradiation, is also shown for comparison. The calculated 3D structures of the conformers I, II and III are shown below the spectra.

Figure 4A:
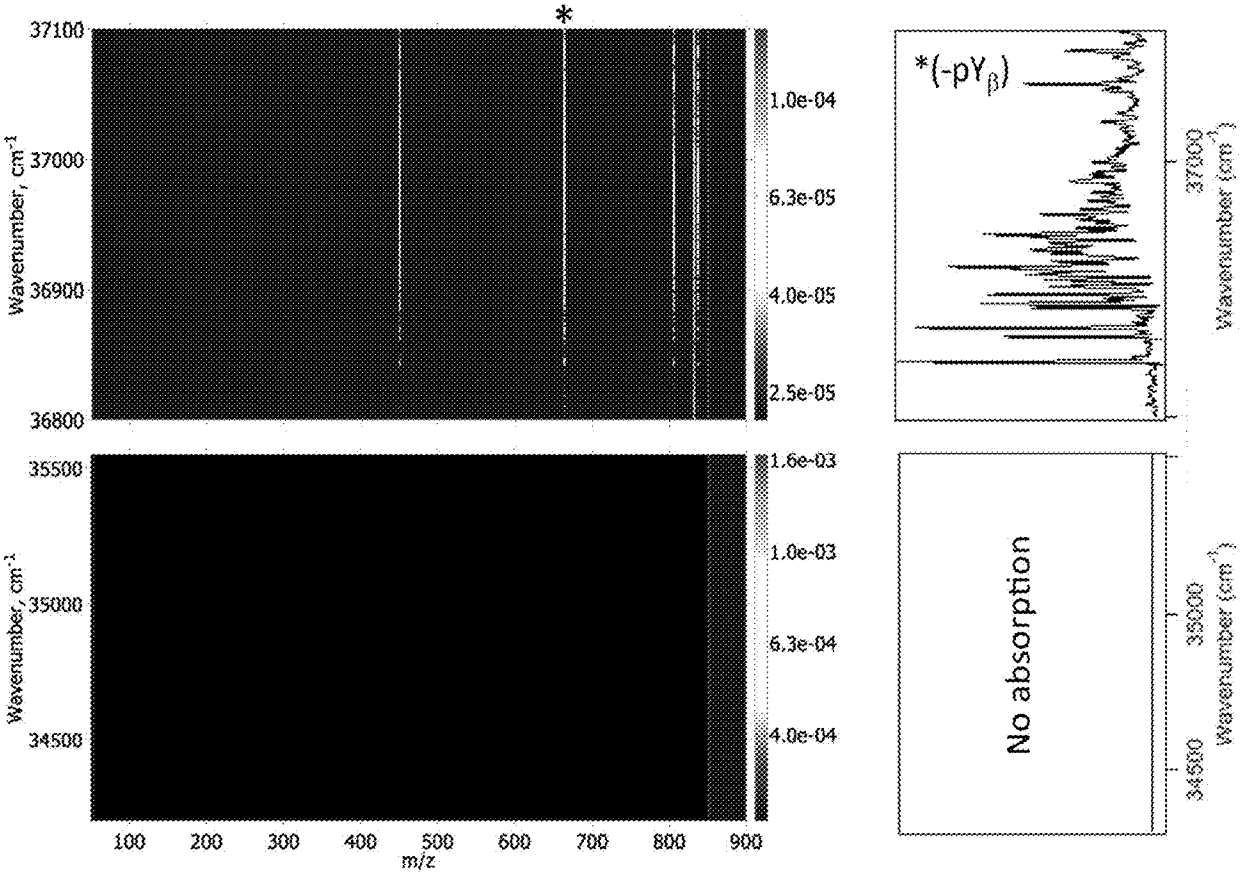
Figure 4B:
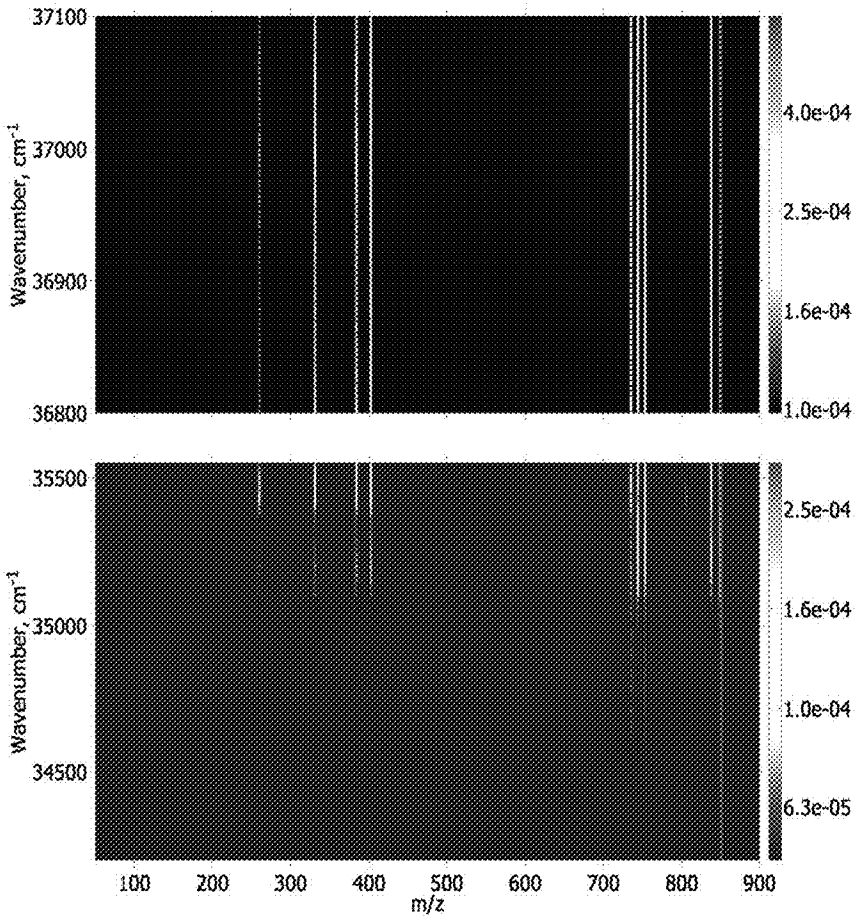
Figure 4C:
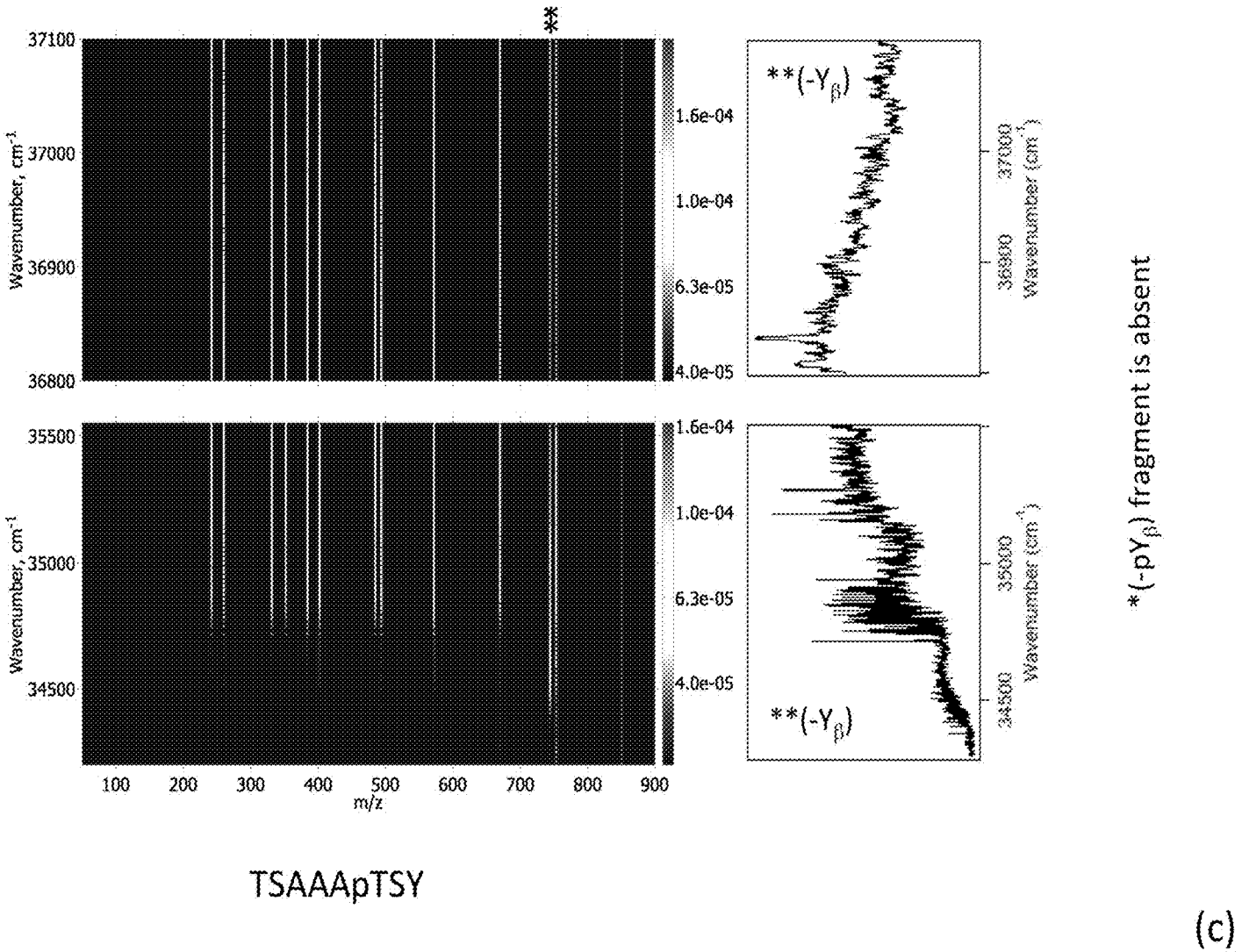
Figure 4D:
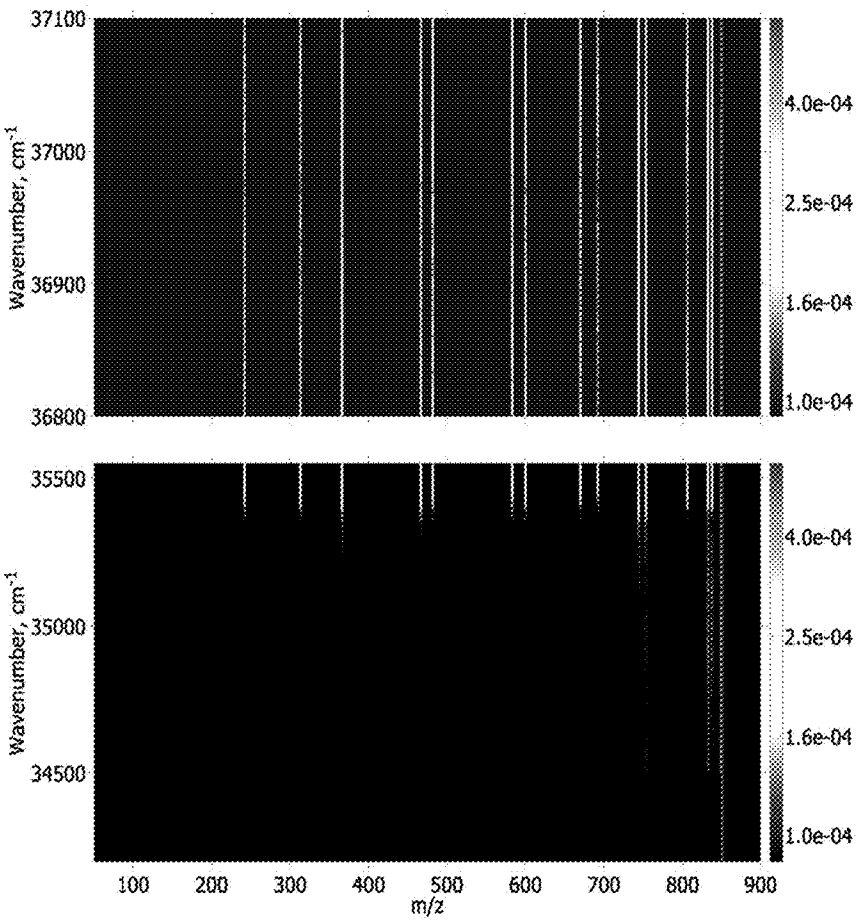
Figure 4E:
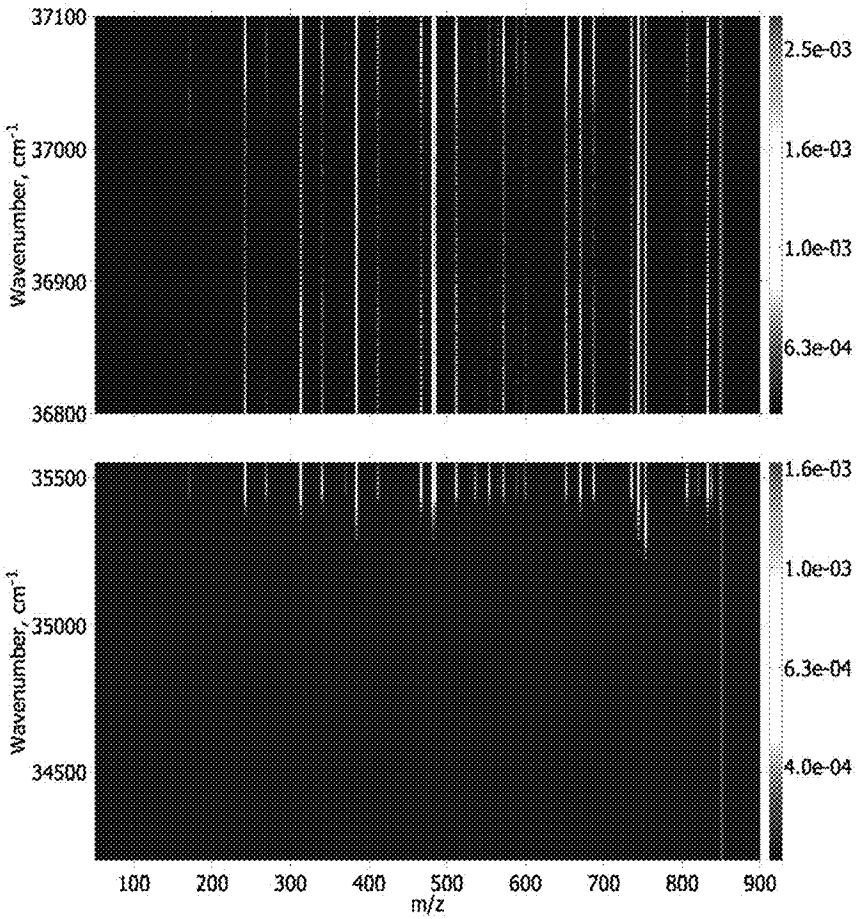
Figure 4F:
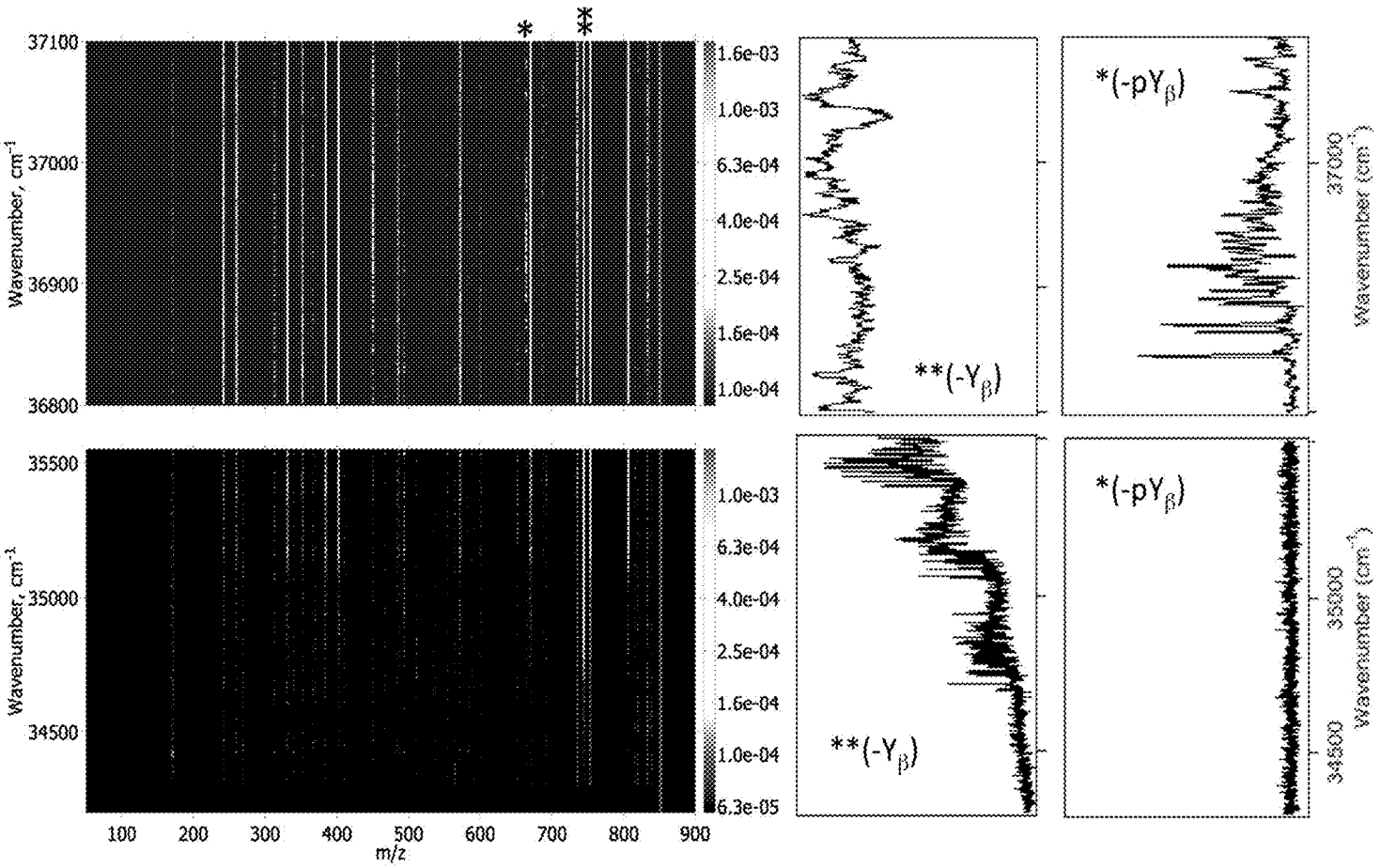

FIGS. 4A-4E show fragments of 2D spectra for five isobaric phosphopeptides of the test library and FIG. 4F shows the 2D spectrum of an isobaric peptide mixture; all acquired by means according to various aspects of the present disclosure. The UV spectra, obtained by cutting the 2D spectra at m/z of two specific fragments are shown, as examples, for two isobaric peptides (a, c) and for the 2D spectrum of the mixture (f). The three peptides and their relative concentrations in the mixture have been determined by mathematical analysis (non-negative least squares) of the 2D spectra of the mixture, using 2D spectra of five candidates of the library.

DESCRIPTION OF EMBODIMENTS

In order to enable a more detailed understanding of the disclosure, numerous embodiments will now be described by way of example and with reference to the accompanying drawings.

Figure 1:
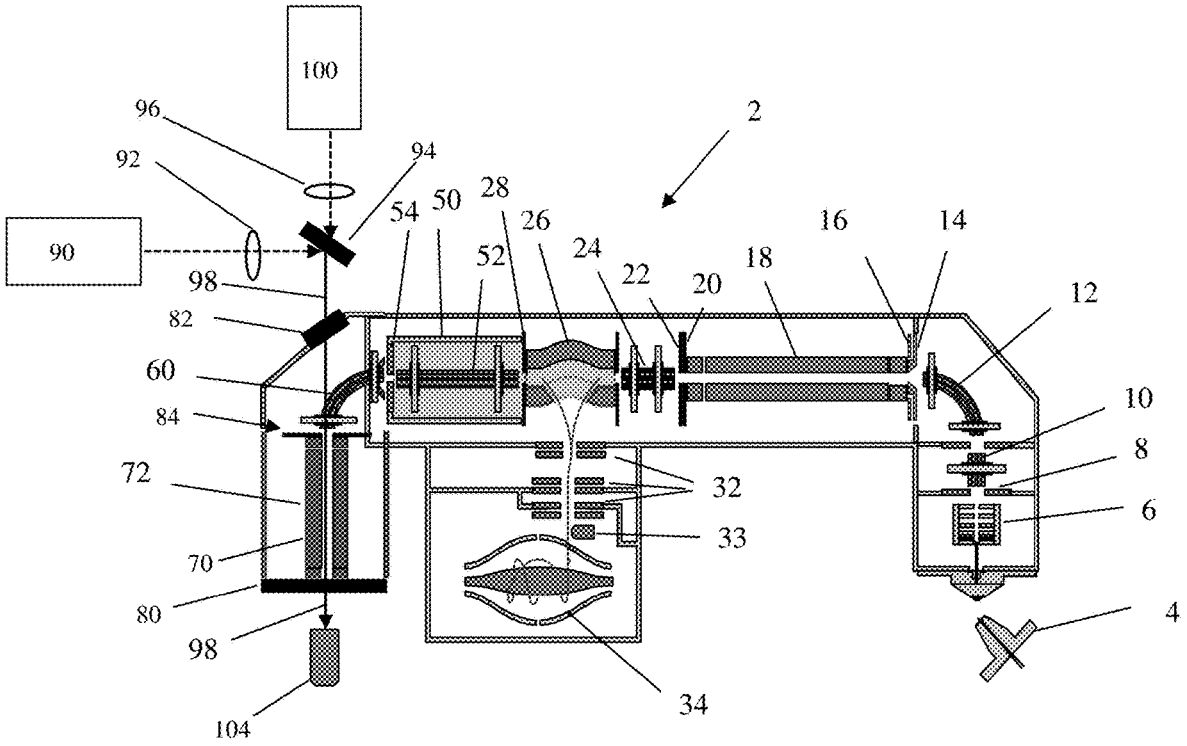
FIG. 1 shows schematically an apparatus for analyzing molecules according to various embodiments.

Referring to FIG. 1 there is shown an apparatus 2 for analyzing molecules. The apparatus comprises a modified Q Exactive mass spectrometer from Thermo Scientific. The apparatus 2 is under the control of a controller, such as an appropriately programmed computer (not shown), which controls the operation of the various components and, for example, sets the voltages to be applied to the various components and which receives and processes data from various components including the detectors.

A liquid sample containing molecules to be analyzed (not shown) is introduced to an electrospray ion source 4 and gas-phase ions are generated from the molecules as a continuous stream. A common sample type contains peptides that are dissolved in a water/methanol solution for use with the electrospray ionization technique to bring them to the gas phase. In a preferred embodiment, the sample comes from an interfaced instrument such as a chromatograph (not shown). The generated ions are transferred by an RF only S-lens (stacked ring ion guide) 6 (RF amplitude 0-350 Vpp, being set mass dependent) and pass the S-lens exit lens 8 (typically held at 25V offset). The ions in the ion beam are next transmitted through an injection multipole 10 and a bent flatapole 12 which are RF only devices to transmit the ions to the downstream optics, the RF amplitude being set mass dependent. The ions then pass through a pair of lenses (both mass dependent, with inner lens 14 typically at about 4.5V, and outer lens 16 typically at about −100V) and enter a mass resolving quadrupole 18.

The quadrupole 18 DC offset is typically 4.5 V. The differential RF and DC voltages of the quadrupole 18 are controlled to either transmit all ions (RF only mode) or select ions of particular m/z for transmission by applying RF and DC according to the Mathieu stability diagram. It will be appreciated that in other embodiments, instead of the mass resolving quadrupole 18, an RF only quadrupole or multipole may be used as an ion guide but the spectrometer would lack the capability of mass selection before analysis. In still other embodiments, an alternative mass resolving device may be employed instead of quadrupole 18, such as a linear ion trap, magnetic sector or a time-of-flight analyzer, or other mass filter. As a further alternative to quadrupole 18, an ion mobility separator such as an ion mobility drift-tube or FAIMS device could be used in its place.

Turning back to the shown embodiment, the ion beam which is transmitted through quadrupole 18 exits from the quadrupole through a quadrupole exit lens 20 (typically held at −35 to 0V, the voltage being set mass dependent) and is switched on and off by a split lens 22 adjacent the exit lens. Then the ions are transferred through a transfer multipole 24 (RF only, RF amplitude being set mass dependent) to a curved linear ion trap (C-trap) 26.

The C-trap is elongated in an axial direction (thereby defining a trap axis) in which the ions enter the trap. In one mode of operation, the voltage on the C-Trap exit lens 28 can be set in such a way that ions cannot pass and thereby get stored within the C-trap 26. This mode can be used to collect mass spectra of unfragmented precursor ions received from the mass resolving quadrupole 18, wherein ions which are stored within the C-trap 26 are ejected orthogonally to the axis of the C-trap (orthogonal ejection) by pulsing DC to the C-trap. In this way, the ejected ions from the C-trap are injected, in this case via Z-lens 32, and deflector 33 into a mass analyzer 34, which in this case is an electrostatic orbital trap mass analyzer, and more specifically an Orbitrap FT mass analyzer made by Thermo Fisher Scientific. Alternatively to the Orbitrap mass analyzer shown, a single-reflection or multiple-reflection or multiple-deflection TOF, or a FT-ICR, or an electrostatic trap, or a distance-of-flight mass analyzer with an array detector, or other suitable mass analyzer may be used. High-resolution accurate-mass (HR-AM) mass analyzers, such as an Orbitrap mass analyzer are preferred.

In operation, in order to effect photofragmentation of the ions, the voltage on the C-Trap exit lens 28 is set to allow the ions to pass through the C-trap (being transmitted axially) towards collision cell 50 (a high energy collision dissociation (HCD) cell). The ions can be injected into the collision cell by an appropriate voltage between the C-trap and the collision cell (e.g. the collision cell may be offset to negative potential for positive ions). The collision energy can be controlled by this voltage. However, before photofragmentation is effected, the ions entering the collision cell 50 from the C-trap are not energized for collisional dissociation as the ions pass through the collision cell downstream to be fragmented. The collision cell 50 comprises a multipole 52 to contain and guide the ions using axial voltage gradient. As described further below, the collision cell 50 may contain a collision gas so as to increase a photofragmentation yield of ions that have been photoactivated further downstream as hereafter described.

In photofragmentation mode, the ions exit the collision cell 50 through aperture 54 and pass into RF-only bent multipole 60 which guides the ions into a cold ion trap 70 located at the end of the ion optical path behind the bent RF-only multipole 60 for storage and cooling of the ions as well as photofragmentation. The ion trap 70 comprises an octapole 72 to contain the ions. The geometry of bent multipole 60 allows convenient access for light to irradiate the ions in the cold ion trap (from sources such as UV and/or IR laser beams as hereafter described) as well as avoids carryover of warm gas from the collision cell 50 and C-trap 26 into the cold ion trap 70. Alternatively, electrostatic bender optics may be employed in place of the bent RF-only multipole 60 but the RF-only multipole further allows lossless transport of ions in the opposite direction to the mass analyzer in order to acquire panoramic spectra of fragment ions. Generally, a preferred geometry of the bent multipole 60, or alternative bent ion optics, includes a 90 degree bend in the ion optical path. The bent RF-only multipole 60 is implemented as a set of printed circuit boards, which is a preferred construction although other constructions, e.g. using rods, are possible.

The cold ion trap 70 (FIG. 1*a*, O. Boyarkin, V. Kopysov, Rev. Sci. Instr. 85, 033105-1 (2014)) is mounted on the second stage of a two-stage closed cycle refrigerator (e.g. Sumitomo, RDS-407), which uses compressed He gas as working body and is capable of cooling the trap as low as to 6 K. The working range may be typically 6-20K, or 10-20K. The ion trap 70 is covered by a housing to minimize radiative heating of the trap and to confine the cooling gas, helium, which is pulsed into the trap through an electrically controlled pulsed gas valve (not shown). He is the cooling gas of choice because it is non-condensing above 4K. The gas pulse duration is typically 0.3-0.5 ms. The pressure of He gas in the cold ion trap is typically 0.5 mbar immediately after the gas pulse and it typically drops to below $10^{-4}$ mbar at the moment of the irradiating the trapped ions with the light. The cooling gas is cooled through collisions with the walls of the ion trap and thereby the ions stored in the ion trap may cool through collisions with the cooling gas.

The filling of the cold ion trap with precursor ions, optionally using mass selection of precursors by the mass selective quadrupole 18, may be done in a data-dependent manner as known in the art, e.g. using a process of automatic gain control. In this way, the ion population of precursor ions in the cold ion trap can be controlled to an optimum level as known in the art using information acquired from one or more previous mass analysis scans by the mass analyzer, including optional dedicated pre-scans. This avoids overfilling or underfilling the ion trap 70 with precursor ions.

The typical frequency of the electrical RF sine waveforms applied to the eight electrodes of the octapole is 1 MHz with peak-to-peak amplitude of 50-100 V. The typical pole bias of the octapole is 1-3 V lower, than that of the C-trap, during the ion injection and 1-3 V higher than that of the C-trap during the release of ions from the octapole; the potential of the endcap 84 of the trap is typically 3-5 V above that of the pole bias, when the ions are trapped. The potential of the endcap lowers to −5 V relative to pole bias for a pulsed release of ions from the trap.

Once ions arrive in the cold ion trap 70, the duration of their cooling is typically 5-10 ms. It is determined by collisions with cold bath gas and their size. Only after ions are cooled does the optical spectroscopy experiment begin.

The optical set-up comprises a UV laser 90 and an IR laser 100 positioned orthogonally to each other. Light from the UV laser is focused by UV lens 92 and is reflected through 90 degrees by the beam combiner 94 so that it is directed along the irradiation axis 98 whereupon it is transmitted through optical window 82, through the bent multipole 60 and into the cold trap 70. The light from IR laser 100 is focused by IR lens 96 and is transmitted by the beam combiner 94 so that it too is directed along the irradiation axis 98 whereupon it is transmitted through optical window 82, through the bent multipole 60 and into the cold trap 70. In a more simple set-up for UV-MS, the IR laser 100 can be omitted and the beam combiner 94 can be a simple UV mirror (i.e. the IR laser is an optional light source). The laser beams exit the cold trap through optical window 80. Also shown is an optional beam stop 104 for termination of the laser beams.

A typical experimental cycle lasts 50 ms. It begins with loading the trap typically 1 ms after pulsing He gas into it. After cooling the dissociating light pulses arrive, typically 20-40 ms after the He pulse. Once the residual He is pumped out, typically 40-50 ms after the gas pulse, the ions are released from the cold trap and transferred to the C-trap of the Orbitrap for MS analysis of the photofragments. Optionally they can be additionally activated in the collision cell 50. In each cycle of measurements the wavelength of the scanned laser (either UV or IR) is read and stored as a tag of the mass-scan.

The whole cycle is controlled by a controller that defines the repetition rate of the experiment and synchronizes trapping, cooling and release of ions from the trap with light pulses and with the measuring cycle of the Orbitrap mass analyzer.

The embodiment shown uses two light sources which include UV and IR tunable pulsed laser sources as described further below. The UV laser source in this embodiment is a pulsed (of ns pulse duration) optical parametric oscillator-amplifier (OPO-OPA) system that is widely tunable in visible spectral region. Alternatively, the UV light source could be a tunable dye laser. In either case, the UV laser source is pumped by the $2^{nd}$ or $3^{rd}$ harmonic of a Nd:YAG pulsed laser and in either case the laser source is equipped with nonlinear harmonic converters to generate UV light in the spectral region of 380-200 nm. The IR light source is an IR OPO-OPA system, tunable in the spectral range of 12-2.5 μm and pumped by a pulsed Nd:YAG laser. The preferred linewidth of the UV light is 0.2-1 $cm^{-1}$ and that of the IR light is 2-5 $cm^{-1}$. The preferred intervals of UV laser wavelength are those around the onsets of UV absorption (electronic band origins) of the known chromophore groups (determined in FIG. 4 of the article: V. Kopysov, N. Nagornova, and O. Boyarkin, JACS, 136, 9288 (2014)). This includes the following intervals, specific for peptides, containing particular aromatic residues: 34500-35200 $cm^{-1}$ for tryptophan, 34500-35400 $cm^{-1}$ for tyrosine, 36200-37100 $cm^{-1}$ for phosphotyrosine, 37400-37800 $cm^{-1}$ for phenylalanine residues. The preferred intervals for VUV fragmentation of peptides and UV/VUV fragmentation of non-peptide aromatic ions are typically broader. The preferred pulse energy of the light sources is >2 mJ/pulse.

The apparatus includes two windows 80, 82 for transmitting the laser light into the cold ion trap 70. One window 80 is adjacent the end of the cold ion trap 70 at the end of the ion optical path, and the other window 82 is adjacent the bent RF-only multipole 60. Both windows are placed at the Brewster angle (ca. 56° between the normal to the window surface and the laser beams) to minimize surface reflections, and allow a clear line of sight for the laser beams to irradiate the ions in the cold ion trap. Preferably, the windows and other optics (e.g. lenses) are made of $BaF_2$ for simultaneous transmittance of UV and IR light. Both IR and UV beams enter to the vacuum chamber of the trap 70 though the same window 82 and leave the chamber through the window 80. Alternatively, the beams could counter propagate, such that one of the windows serves for transmitting the UV beam and the second for the IR beam. In such a case (not shown in FIG. 1) the first window can be made of $CaF_2$ or UV fused silica and the second window of $BaF_2$ material to ensure the lowest absorption losses for the UV and IR light respectively. In general, both windows should be transparent for both wavelengths or at least one transparent in UV and the second transparent in IR, but both may absorb the non-transmitted wavelength only in volume, not in a thin layer.

In a UV spectroscopic mode of operation the pulsed irradiation of precursor ions in the cold ion trap 70 is first performed at a first UV wavelength ($\lambda_1$) for the purpose of inducing photofragmentation of the ions to form fragment ions. If the ions absorb the UV light at this wavelength, they may dissociate, yielding photofragment ions with m/z different from that of precursor ions. Any fragment ions and any unfragmented ions are then ejected from the cold ion trap and transferred back upstream towards the C-trap 26. Optionally, the unfragmented ions that have been photoactivated or excited may be energized to undergo collisional dissociation in the collision cell 50, which increases the yield of ion fragments to be mass analyzed, but also may result in the appearance of new ion fragments. The ions including any ion fragments are then trapped in the C-trap 26 and from there are injected into the Orbitrap mass analyzer 34 as described above. A panoramic fragment mass analysis (wide m/z range) is then performed by the mass analyzer and a detected signal (I) from the analyzer is recorded on a data acquisition system (not shown). This provides a mass spectrum (i.e. detected signal (I) against m/z) corresponding to the first wavelength of irradiation ($\lambda_1$) (i.e. a fragment mass-spectrum at the given laser wavelength). The whole process is then performed again for another batch of precursor ions accumulated in the ion trap 70 but this time irradiated at a second wavelength ($\lambda_2$) and subsequently for further wavelengths up to $\lambda_n$ where n is the number of wavelengths of irradiation used. In other words, the wavelength is incremented and the whole cycle of the measurement repeated until n wavelengths have been studied. The preferred wavelength step is less than 0.04 nm. Optionally, at each wavelength two or more mass spectra could be recorded and averaged to improve the signal.

In the IR spectroscopic mode, the UV light wavelength is fixed either on an absorption UV peak (conformer selective depletion IR spectroscopy) or slightly outside of the UV absorption spectrum (conformer non-selective gain IR spectroscopy), while the wavelength of the preceding IR laser pulse changes in each cycle of measurements as described above for UV spectroscopic mode of operation. The typical time delay between the IR and UV pulses is 50-100 ns. The preferred wavelength step is less than 5 $cm^{-1}$.

The produced data is a set of fragment mass-spectra, each labelled by the wavelength of the scanning (IR or UV) laser. This makes up a 3D data array or spectrum, which contains optical absorption spectra measured for each photofragment, as well as photofragment mass-spectra measured at each wavelength. In FIG. 2 is shown a simple example of a 3D data array (signal (I) vs $\lambda$ (expressed as wavenumber) and m/z) (wherein only those m/z that correspond to substantial photofragmentation are shown) of a dipeptide measured by scanning the wavelength of the UV excitation laser while monitoring all appearing photofragments with the Orbitrap mass analyzer.

Since both the UV absorption and the fragmentation can be very specific to the selected ions under study, the 3D spectrum contains data on this specificity and is especially characteristic (as a fingerprint) for the selected ions (and thus the original molecules from which the ions were produced).

The measured spectrum (i.e. intensity (I) vs m/z and $\lambda$) can be normalized to the total number of precursor ions or, as a good approximation to this, to the total ion current (TIC) detected.

Figure 3:
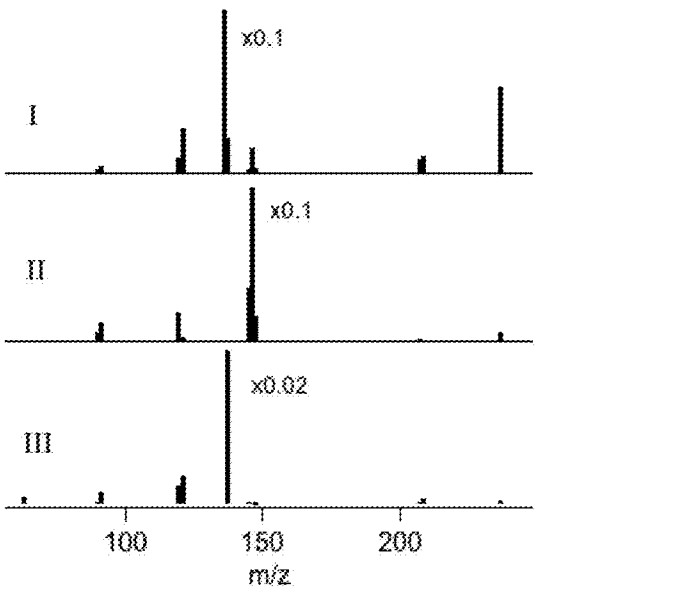
FIG. 3 shows UV absorption spectra (left side) and the corresponding photofragmentation mass spectra (right side)
Figure 3:
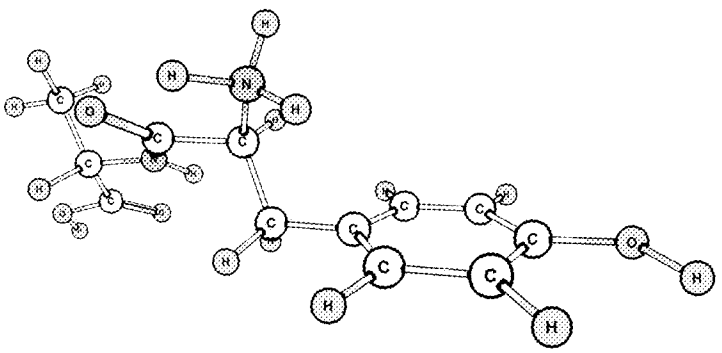
Figure 3:
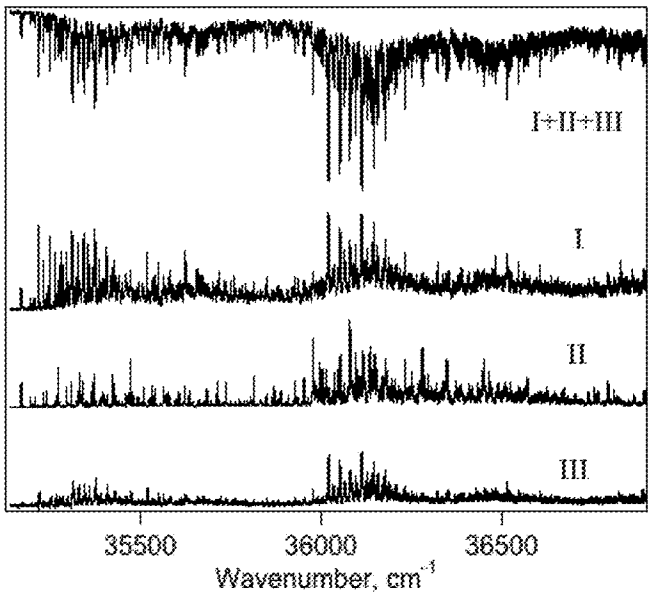
Figure 3:
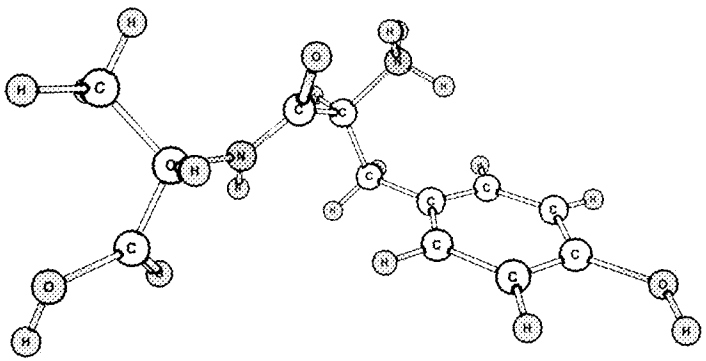

If all the ions are of the same chemical structure (e.g. a single sequence for a peptide) but contain different isomers (e.g. conformers), which differ in fragmentation yield to different channels at certain wavelength(s), the 3D data array can be mathematically decomposed to pairs of vectors, which correspond to different isomers (conformers) of the ions, and to a diagonal matrix, which shows the relative abundance of these isomers. In each pair of vectors, one vector corresponds to the so-called optical absorption spectrum (i.e. I vs $\lambda$) and the second vector corresponds to the so-called fragmentation mass-spectrum (i.e. I vs m/z) of one particular isomer (conformer). An example is shown in FIG. 3, which shows UV optical absorption spectra (left side) (i.e. I vs $\lambda$) and the corresponding mass spectra (i.e. I vs m/z) of the three most abundant conformers of the $[YA-H]^+$ peptide. The spectra have been mathematically extracted from the 2D spectrum shown in FIG. 2, using a singular value decomposition (SVD) with subsequent alternating least squares (ALS) optimization of the decomposition. Other mathematical methods, e.g. non-negative matrix factor analysis, could also be used. The number of the pairs of vectors (I, II, III) gives the number of the most essential isomers (conformers) present, i.e. three in this case. Calculations show (at the bottom of FIG. 3), that the main difference between the species I and II is the orientation of the aromatic ring relative to the peptide backbone and the distance between the ring and the N-terminus. The species III has the structure of the species I, but it contains one $^{13}C$ isotope in the ring.

The I(m/z) vector (fragmentation mass spectrum) can be used for the determination of a chemical structure of the precursor ions present in the ion trap using MS approaches known in the art. The I($\lambda$) vector (optical spectrum) can be used for structural determinations, in particular for validation of calculated 3D structures of ionic conformers present in the ion trap. High-level calculations can produce a pool of candidate 3D structures and for each candidate structure the absorption spectrum I($\lambda$) (IR, UV or both) is calculated too. These calculated candidate spectra are then compared with the decomposed (that is conformer-selective, where only one molecule is under study) experimental spectra (vectors I($\lambda$)). Once a good match between an experimental spectrum and a calculated one has been achieved, the corresponding calculated structure is deemed validated. This approach is particularly appropriate for small peptides, drugs and metabolites.

In another type of experiment, there may be a mixture of a few structurally different ions but perhaps having the same or nearly the same m/z (e.g. isobaric peptides), which may be difficult to identify by MS alone. If 3D data for each suspected candidate ion have been measured in accordance with the disclosure, it is possible to decompose the measured 3D data of the mixture on the basis of the known candidate 3D data to determine the presence and the relative abundance of the ions in the mixture. In FIG. 4 is shown how such an identification of ions can work. A mixture of singly charged isobaric peptides was studied. A test library pool of 5 candidate peptides with known 2D spectra (acquired earlier in accordance with various aspects of the disclosure) was used for reference. These five reference 2D spectra are shown in FIG. 4(*a*)-(*e*). In FIG. 4(*f*) is shown the 2D spectrum of the mixture acquired in accordance with various aspects of the disclosure. The spectra show the two axes of m/z and UV photon energy (in $cm^{-1}$) and the signal intensity is indicated by an appropriate color mapping (not visible in the black and white image shown). For each 2D spectrum two panels are shown for graphical clarity, which correspond to two wavelength regions that contain the onsets of absorptions but are also the most specific regions. Also shown are some of the 2D fingerprints at m/z=744.269 Da and m/z=664.302 Da, which correspond to $C_\alpha$-$C_\beta$ bond cleavage in Tyr and pTyr respectively (loss of tyrosine side chain and phosphorylated tyrosine side chain). Using a least squares analysis of the 2D spectra of the mixture, it was possible to correctly suggest the presence of the 3 components in the mixture.

It will be appreciated that the path of the ion beam through the apparatus and in the mass analyzer is under appropriate evacuated conditions as known in the art, with different levels of vacuum appropriate for different parts of the spectrometer.

It will be appreciated that numerous parameters or quantities described herein, such as wavelength and m/z, may be expressed in alternative but conventionally understood terms. For example, herein a wavelength may be expressed as an equivalent wavenumber ($cm^{-1}$) or an energy (eV etc.) or frequency and thus reference to wavelength includes a reference to wavenumber, energy or frequency. Herein the terms mass and mass-to-charge ratio (m/z) are used interchangeably. Moreover, the terms include measured quantities related to mass or m/z, for example frequency in FTMS and time in TOF mass spectrometry.

It will be appreciated that variations to the foregoing embodiments of the disclosure can be made while still falling within the scope of the disclosure. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate aspects of the disclosure and does not indicate a limitation on the scope unless otherwise claimed. No language in the specification should be construed as indicating any non-claimed element as essential to the practice of aspects of the disclosure.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features are applicable to all aspects and may be used in any combination. Likewise, features described in non-essential combinations may be used separately (not in combination).

What is claimed is:

1. An apparatus for analyzing a sample of molecules, comprising:

an ion generator for generating ions from the molecules;

an ion trap downstream from the ion generator for receiving the generated ions, wherein the ion trap is configured to be cooled to a temperature below ambient temperature and provided with gas that is non-condensing at the below ambient temperature for cooling the ions;

a light source for irradiating the cooled ions with light at a plurality of different wavelengths (λ) within one or more predetermined spectral intervals, the wavelength of light, in use, being scanned over the plurality of different wavelengths, to cause fragmentation of the ions thereby forming fragment ions, wherein the wavelength of the light can be varied; and a mass analyzer for mass analysis of the fragment ions, wherein the mass analysis is configured to analyze a plurality of fragment ions in parallel wherein the apparatus is connected to a chromatographic apparatus whereby the sample is contained in an eluent from the chromatographic apparatus;

wherein the light source and mass analyzer are configured to operate such that for each chromatographic peak of interest the mass analysis of the fragment ions is conducted at each of a plurality of wavelengths of the light (λ), thereby enabling a two-dimensional spectrum of a detected signal (I) of the mass analyzer on m/z and irradiation wavelength (λ) to be recorded for that chromatographic peak.

2. An apparatus as claimed in claim 1 wherein the ion generator is an atmospheric pressure ionization source.

3. An apparatus as claimed in claim 1 wherein the light source comprises one or more sources of ultraviolet UV, Vis or IR light.

4. An apparatus as claimed in claim 3 wherein at least one of the sources of light is configured to cause fragmentation of the ions.

5. An apparatus as claimed in claim 3 wherein at least one of the sources of light is tuneable.

6. An apparatus as claimed in claim 3 wherein the light source comprises two or more light sources for irradiating the ions, which includes a first light source for causing fragmentation of the ions and another light source for modifying the fragmentation caused by the first light source.

7. An apparatus as claimed in claim 3 wherein the light source comprises a UV light source and an IR light source, at least one of which is tunable.

8. An apparatus as claimed in claim 1 wherein the apparatus comprises at least one optical window for transmitting the light from the light source into the ion trap.

9. An apparatus as claimed in claim 1 wherein the ion trap is linked to the mass analyzer and/or the ion generator via ion optics that comprises at least one RF-only multipole or at least one electrostatic ion bending device, wherein the RF-only multipole or electrostatic ion bending device is bent such that there is no direct line of sight between ions trapped in the ion trap and an exit from the RF-only multipole or electrostatic ion bending device.

10. An apparatus as claimed in claim 9 wherein the at least one RF-only multipole or at least one electrostatic ion bending device allows the light source to freely irradiate the ion trap through the RF-only multipole or electrostatic ion bending device.

11. An apparatus as claimed in claim 9 wherein the ion trap is located at the end of an ion optical path downstream of the RF-only multipole.

12. An apparatus as claimed in claim 1 wherein the ion trap is one of: a linear RF multipole trap, a 3D RF quadrupole trap, or a ring-electrode RF trap.

13. An apparatus as claimed in claim 1 further comprising a device downstream of the ion generator for selecting the generated ions based on a physico-chemical property of the ions, wherein the device is located upstream of the ion trap.

14. An apparatus as claimed in claim 13 further comprising a multipole mass filter downstream of the ion generator for mass selecting the generated ions, wherein the mass filter is located upstream of the ion trap.

15. An apparatus as claimed in claim 1 further comprising a collision cell for receiving ions that have been photoactivated by the irradiation with light, wherein the collision cell is configured to be provided with buffer gas to increase a yield of the fragmentation by collisions of ions with the buffer gas.

16. An apparatus as claimed in claim 1 wherein the mass analyzer is one of: a linear ion trap mass analyzer, an orbital trap mass analyzer, an FT-ICR mass analyzer, or a TOF mass analyzer.

17. An apparatus as claimed in claim 1 further comprising a data acquisition system for recording a fragment mass spectrum from the mass analysis comprising a detected signal (I) versus m/z over a predetermined range of m/z values for each of a plurality of different wavelengths (λ) of the light, thereby recording a two-dimensional dependency of the detected signal (I) on m/z and irradiation wavelength (λ).

18. An apparatus as claimed in claim 17 wherein the data acquisition system is for determining from a two-dimensional spectrum of the detected signal (I) on m/z and irradiation wavelength (λ) an identity of at least one of the molecules and/or relative abundances of different molecules in the sample.

* * * * *